US010431868B2

(12) United States Patent
Samardzija et al.

(10) Patent No.: US 10,431,868 B2
(45) Date of Patent: Oct. 1, 2019

(54) ANTENNA STRUCTURE INCORPORATED IN HEAT SPREADER, HEAT SINK, AND COOLING FINS

(71) Applicant: Plume Design, Inc., Palo Alto, CA (US)

(72) Inventors: Miroslav Samardzija, Mountain View, CA (US); William McFarland, Portola Valley, CA (US); Jeffrey ChiFai Liew, Millbrae, CA (US); Patrick Hanley, San Mateo, CA (US); Yoseph Malkin, San Jose, CA (US); Richard Tzewei Chang, Sunnyvale, CA (US); Duc Minh Nguyen, San Jose, CA (US); Liem Hieu Dinh Vo, San Jose, CA (US)

(73) Assignee: Plume Design, Inc., Palo Alto, CA (US)

( * ) Notice: Subject to any disclaimer, the term of this patent is extended or adjusted under 35 U.S.C. 154(b) by 267 days.

(21) Appl. No.: 15/603,650

(22) Filed: May 24, 2017

(65) Prior Publication Data

US 2018/0342784 A1 Nov. 29, 2018

(51) Int. Cl.

| | |
|---|---|
| ***H01Q 1/42*** | (2006.01) |
| ***H01Q 1/02*** | (2006.01) |
| ***H01Q 1/48*** | (2006.01) |
| ***H01Q 1/00*** | (2006.01) |
| ***H01Q 1/36*** | (2006.01) |
| ***H01Q 1/38*** | (2006.01) |
| ***H01Q 1/44*** | (2006.01) |
| ***H01Q 9/42*** | (2006.01) |
| ***H01Q 13/10*** | (2006.01) |
| ***H01Q 21/06*** | (2006.01) |
| ***H01Q 21/28*** | (2006.01) |

(52) U.S. Cl.

CPC ..... *H01Q 1/02* (2013.01); *H01Q 1/007* (2013.01); *H01Q 1/36* (2013.01); *H01Q 1/38* (2013.01); *H01Q 1/44* (2013.01); *H01Q 1/48* (2013.01); *H01Q 9/42* (2013.01); *H01Q 13/106* (2013.01); *H01Q 21/065* (2013.01); *H01Q 21/28* (2013.01)

(58) Field of Classification Search

CPC ..... H01Q 1/02; H01Q 1/007; H01Q 1/36; H01Q 1/38; H01Q 1/48; H01Q 1/42

USPC ..... 343/872

See application file for complete search history.

(56) References Cited

U.S. PATENT DOCUMENTS

| | | | |
|---|---|---|---|
| 6,853,197 | B1 | 2/2005 | McFarland et al. |
| 6,961,545 | B2 | 11/2005 | Tehrani et al. |
| 7,245,882 | B1 | 7/2007 | McFarland |
| 7,245,893 | B1 | 7/2007 | Husted et al. |
| 7,251,459 | B2 | 7/2007 | McFarland et al. |
| 9,136,937 | B1 | 9/2015 | Cheng et al. |
| 9,160,584 | B1 | 10/2015 | Kavousian et al. |

(Continued)

*Primary Examiner* — Huedung X Mancuso

(74) *Attorney, Agent, or Firm* — Clements Bernard Walker PLLC; Lawrence A. Baratta, Jr.

(57) ABSTRACT

An antenna system reusing metallic components in a device includes a first antenna element which is also configured to transfer heat into surrounding air; a ground plane which is part of reused metallic components in the device for heat dissipation; and a first physical connection between the first antenna element and the ground plane which supports thermal conductivity based on an associated size and material of the first physical connection.

20 Claims, 13 Drawing Sheets

(56) References Cited

U.S. PATENT DOCUMENTS

| | | | | |
|---|---|---|---|---|
| 2005/0057421 | A1* | 3/2005 | Mohamadi | H01Q 3/26 343/853 |
| 2006/0043568 | A1* | 3/2006 | Abe | H01L 21/4857 257/698 |
| 2006/0131734 | A1* | 6/2006 | Kummerl | H01L 23/4334 257/706 |
| 2007/0013051 | A1* | 1/2007 | Heyan | H01L 23/5385 257/704 |
| 2007/0018308 | A1* | 1/2007 | Schott | B23K 3/0623 257/700 |
| 2007/0069353 | A1* | 3/2007 | Beer | H01L 23/29 257/678 |
| 2008/0105966 | A1* | 5/2008 | Beer | G01S 7/032 257/690 |
| 2013/0090057 | A1 | 4/2013 | Green et al. | |
| 2013/0293424 | A1 | 11/2013 | Zhu et al. | |
| 2014/0009344 | A1 | 1/2014 | Zhu et al. | |
| 2014/0009355 | A1 | 1/2014 | Samardzija et al. | |
| 2014/0112511 | A1 | 4/2014 | Corbin et al. | |
| 2014/0226572 | A1 | 8/2014 | Thota et al. | |
| 2014/0340265 | A1 | 11/2014 | Vazquez et al. | |
| 2015/0099474 | A1 | 4/2015 | Yarga et al. | |
| 2015/0109167 | A1 | 4/2015 | Yarga et al. | |
| 2015/0195836 | A1 | 7/2015 | Malkin et al. | |
| 2015/0302976 | A1 | 10/2015 | Chang et al. | |
| 2015/0303568 | A1 | 10/2015 | Yarga et al. | |
| 2015/0311960 | A1 | 10/2015 | Samardzija et al. | |
| 2016/0056526 | A1 | 2/2016 | Li et al. | |
| 2016/0336643 | A1 | 11/2016 | Pascolini et al. | |

* cited by examiner

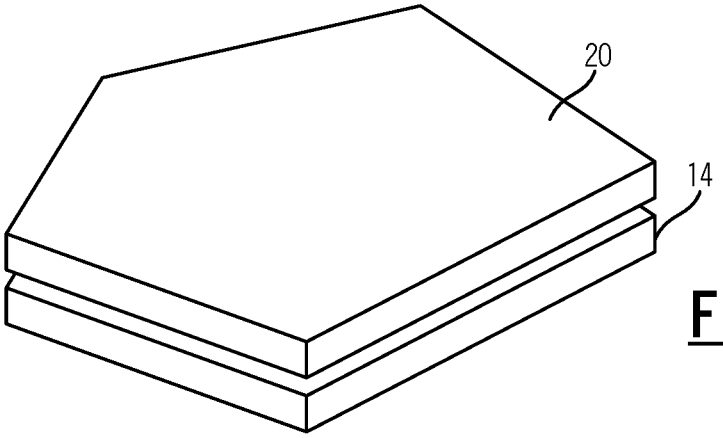
FIG. 14
FIG. 15
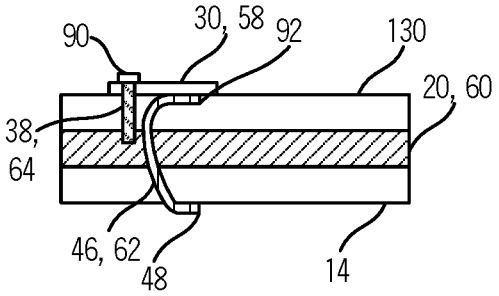
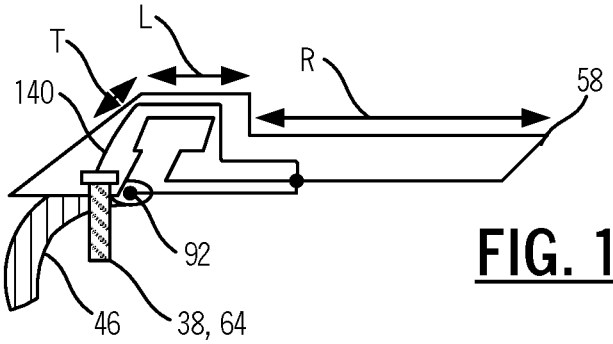
FIG. 16
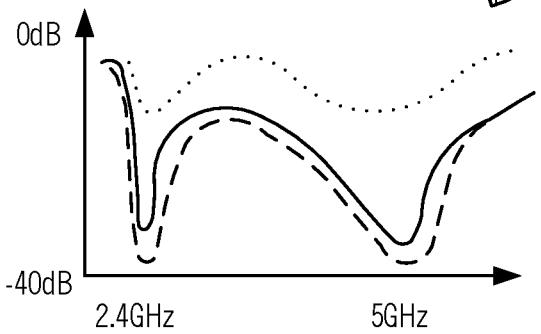
FIG. 17

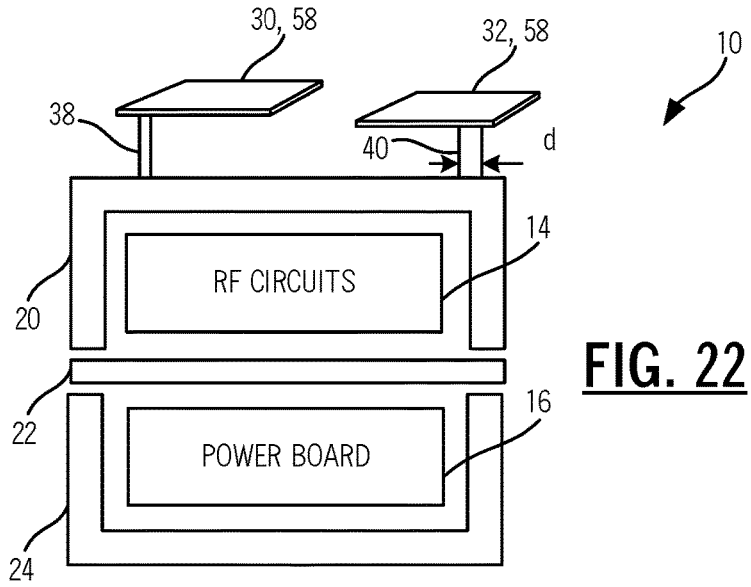
FIG. 22
FIG. 23
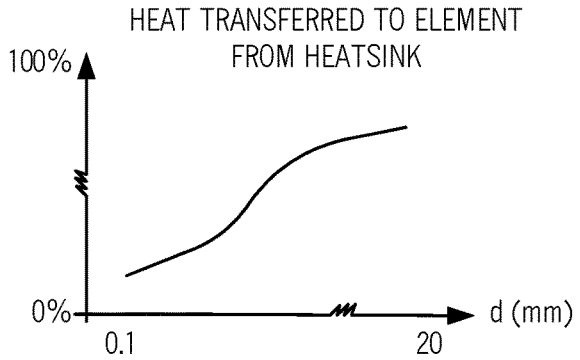
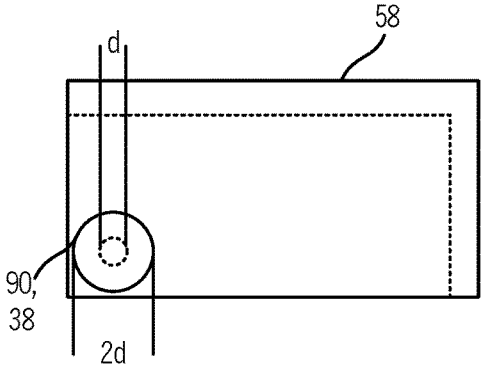
FIG. 24

ANTENNA STRUCTURE INCORPORATED IN HEAT SPREADER, HEAT SINK, AND COOLING FINS

FIELD OF THE DISCLOSURE

The present disclosure generally relates to antenna systems and methods. More particularly, the present disclosure relates to an antenna structure incorporated in a heat spreader, heat sink, and/or cooling fins, such as for use in a high-density, high-integrated wireless device including a wireless Access Point (AP).

BACKGROUND OF THE DISCLOSURE

Various devices utilize antennas for wireless communication, such as mobile phones, wireless Access Points (APs), laptops, tablets, and the like. Conventionally, antennas are included in such devices with adequate clearance between the antenna elements and associated metallic components in the device. However, a trend in device design is the drive by industrial design to build form factors that are appealing to consumers. In the past, engineering drove product form factor, and this worked well with the requirement to clear antenna elements from metallic components. With the trend towards appealing form factors, there are significant real estate limitations in devices which often make it difficult to have such clearance. With limited real estate and smaller form factors, it is becoming impractical to clear the antenna elements from all the metallic components, especially considering increased heat in smaller form factors requiring significant amounts of metal for heat dissipation. It would be advantageous to provide an antenna structure which specifically used existing metallic components in a device as opposed to seeking to clear them.

BRIEF SUMMARY OF THE DISCLOSURE

In an exemplary embodiment, an antenna system reusing metallic components in a device includes a first antenna element which is also configured to transfer heat into surrounding air; a ground plane which is part of reused metallic components in the device for heat dissipation; and a first physical connection between the first antenna element and the ground plane which supports thermal conductivity based on an associated size and material of the first physical connection. The reused metallic components can include a Faraday cage and/or Electromagnetic Interference (EMI) shield for circuitry in the device. The first physical connection can be metal, and supports both electrical conductivity and thermal conductivity. The first antenna element can include an inductance loop between the ground plane via the first metal connection and an antenna connection. The first antenna element can further operate as a cooling fin, and wherein the ground plane is part of a heat sink in the device.

The antenna system can further include a second antenna element which is also configured to transfer heat into surrounding air, wherein the second antenna element shares the ground plane with the first antenna element; and a second physical connection between the second antenna element and the ground plane which supports thermal conductivity based on an associated size and material of the second physical connection. The first antenna element and the second antenna element can be positioned such that effective current flow from the first antenna element and the second antenna element is substantially orthogonal to one another on the ground plane. The second physical connection can metal, and support both electrical conductivity and thermal conductivity. The ground plane can include one or more slits or slots between the first antenna element and the second antenna element.

The first antenna element can be a folded or stacked element to increase the heat transfer. The antenna system can further include an extension plate connected to the first antenna element via an inductor, to increase the heat transfer. The antenna system can further include a second antenna element, a third antenna element, and a fourth antenna element each of which is also configured to transfer heat into surrounding air, wherein the second antenna element, the third antenna element, and the fourth antenna element shares the ground plane with the first antenna element; and a second physical connection between the second antenna element and the ground plane, a third physical connection between the third antenna element and the ground plane, and a fourth physical connection between the fourth element and the ground plane each of which supports thermal conductivity based on an associated size and material of the respective connection.

The first antenna element and the second antenna element can be positioned such that effective current flow from the first antenna element and the second antenna element is substantially orthogonal to one another on the ground plane, and wherein the third antenna element and the fourth antenna element can be positioned such that effective current flow from the third antenna element and the fourth antenna element is substantially orthogonal to one another on the ground plane. The ground plane can include one or more slits or slots between the first antenna element, the second antenna element, the third antenna element, and the fourth antenna element. The reused metallic components can substantially surround one or more of a Radio Frequency (RF) board, a power board, and a Printed Circuit Board (PCB) in the device.

In another exemplary embodiment, a combined antenna and heat sink apparatus in a device includes a heat sink structure enclosing one or more of a Radio Frequency (RF) board, a power board, and a Printed Circuit Board (PCB) in the device, wherein the heat sink structure is one or more of a Faraday cage and/or Electromagnetic Interference (EMI) shield for circuitry and power in the device; and one or more antenna elements thermally coupled to the heat sink structure such that the heat sink structure operates as a ground plane to the one or more antenna structure, the one or more antenna elements operate as cooling fins for the heat sink. The one or more antenna elements can include at least two antenna elements positioned such that effective current flow is substantially orthogonal to one another on the ground plane. The heat sink structure can include one or more slits or slots between the electrical coupling of the one or more antenna elements.

In a further exemplary embodiment, a wireless Access Point (AP) with an antenna structure reusing metallic components in the wireless AP includes Radio Frequency (RF) components; circuitry and power components; a heat sink structure adjacent to the RF components and/or the circuitry and power components; one or more 2.4 GHz antenna elements thermally coupled to the heat sink structure such that the heat sink structure acts as a ground plane to the one or more 2.4 GHz antenna elements; and one or more 5 GHz antenna elements thermally coupled to the heat sink structure such that the heat sink structure acts as the ground plane to the one or more 5 GHz antenna elements. The one or more 2.4 GHz antenna elements and the one or more 5 GHz antenna elements can act as cooling fins for the heat sink structure.

BRIEF DESCRIPTION OF THE DRAWINGS

The present disclosure is illustrated and described herein with reference to the various drawings, in which like reference numbers are used to denote like system components/method steps, as appropriate, and in which:

FIG. 14 is a perspective diagram of an exemplary heat sink on top of an exemplary RF board;

FIG. 15 is a diagram of a side view illustrating connectivity between the RF board, the heat sink, and the antenna element;

FIG. 16 is diagram of a side view of the antenna element illustrating an exemplary shape;

FIG. 17 is graph of the reflection coefficient, $S_{11}$, illustrating effects based on the shape of the antenna element;

FIG. 22 is a diagram of the device with two cooling fins with varying sized metal connections;

FIG. 23 is a graph of heat transfer between the antenna element based on size of the metal connections;

FIG. 24 is a diagram a top view of the antenna element illustrating different sizes for the antenna element and the metal connection;

DETAILED DESCRIPTION OF THE DISCLOSURE

Figure 1:
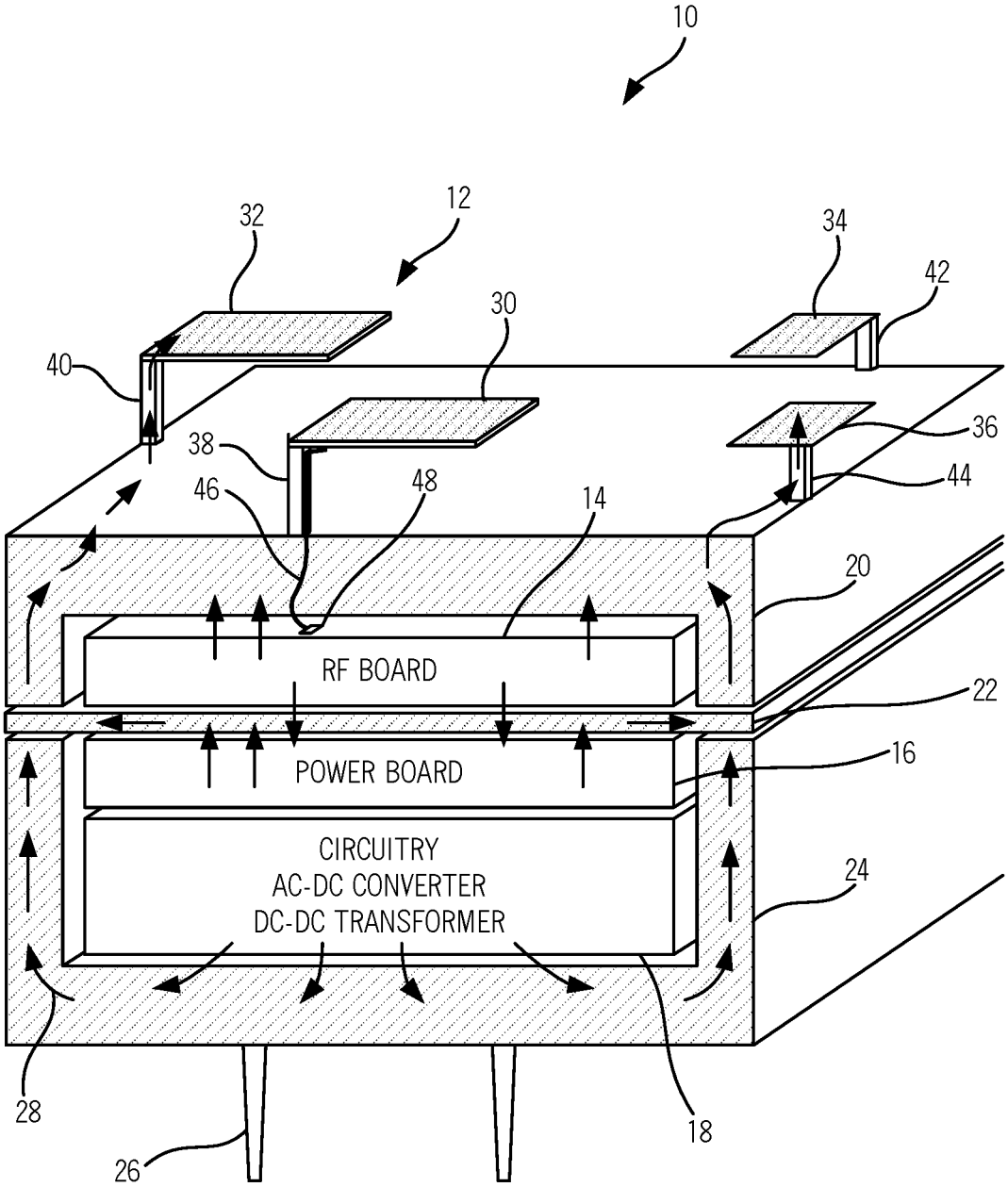
FIG. 1 is a diagram of a cross-section of a device with an antenna structure reusing metallic components in the device.

In various exemplary embodiments, the present disclosure relates to an antenna structure incorporated in a heat spreader, heat sink, and/or cooling fins, such as for use in a high-density wireless device including a wireless Access Point (AP). In general, the device described herein reuses heat spreaders/heat sinks as part of the antenna, uses antenna elements as cooling fins, and reuses the heat sinks as dense Radio Frequency (RF), Electromagnetic Interference (EMI), and Electromagnetic Compatibility (EMC) shield, box, or Faraday cage for other components in the device. In an exemplary embodiment, the antenna structure can be used in a small form-factor, high-density wireless Access Point (AP); however, those skilled in the art will recognize other devices are also contemplated. The foregoing descriptions describe various approaches to adapting to the limitations of reused metal for antenna purposes.

As described herein, the metallic components of the device can include, for example, a heat sink, a heat spreader, cooling fins, and the like. In the various exemplary embodiments described herein, the antenna structure is formed using the heat sink, the heat spreader, the cooling fins, and the like. With respect to size, the antenna structure can use a size of the metallic components close to natural resonance. The antenna structure can include slits, slots, etc. to create sections of the metal of the appropriate size. With respect to shape, the antenna structure can include multiple antennas with a second antenna element as far away from a first element as possible while being fed from a similar location. Also, the second element can be as far above the ground plane as possible. The second antenna element can be large so as to increase efficiency and bandwidth which is made possible by the large first antenna element surface created by reusing metal already in the device. The antenna structure can include adjustment of length, width, and height of the second element to get correct tuning given the non-continuous nature of the first element. The antenna structure can also include adjustment of a direct connection between elements to get correct matching.

The antenna structure can include variation adaptations such as a location of the feed, e.g., close to a corner, adjustments of dimensions and shape of the antenna elements. The antenna elements can include a bend pattern around the edges of the plane of the metal along with increased effective element spacing for better efficiency. The antenna structure can include direct contact (Alternating Current (AC) or Direct Current (DC)) in the second element for matching. This requires direct contact with the second element to the first element.

The metallic components can intentionally be designed non-continuous to aid the properties of the antenna, such as slits, slots, meanders, etc. to benefit the radiation efficiency and/or pattern. The metallic components serve another purpose in the device such as one or more of an EMI shield for internal components of the device, a heat sink, structural form of the housing, and the like. The metallic components are three-dimensional, and the three-dimensionality of the reused metal is used to improve antenna properties. The primary radiating element can be the first element made from reused metal with slots, slits, patterns, etc. intentionally introduced to aid that metal as the primary radiating element.

The antenna structure can include multiple antennas either using the same parts of the metallic components or separate parts. The feed patterns of the multiple antennas can be adjusted as needed, such as at right angles (orthogonal) for the multiple antennas, close to one another to help the placement of circuits since Integrated Circuits (ICs) have multiple antenna outputs from the same IC. The positioning and orienting of the multiple antennas can be to provide polarization diversity. Also, the multiple antennas can use slots, slits, etc. to promote isolation between the antennas.

The metallic components can also include added metal in addition to reused metal to help with heat sinking of the device. The antenna structure can include a strong thermal connection to the heat sink for the reused metal. The added metal can form the antenna with mechanical properties that assist when acting as a heat sink or heat fin. For example, the added metal can include a large area, thick metal for better thermal conduction, a thick ground connection or multiple ground connections for better thermal conduction from the reused metal heat sink, fins to provide greater surface area, mounted in a location where there is airflow, etc.

The antenna structure can include a physical connection to the ground plane that supports heat conduction. Such heat conduction aids the antenna element in serving as a heat fin dissipating heat generated within the device. The heat conducting physical connection can be formed of any heat conducting material, which may be electrically conducting or electrically insulating. Such materials include metal, ceramic, heat pads, thermally conductive grease, or thermally conductive rubber pads.

Antenna Structure in a Device

Referring to FIG. 1, in an exemplary embodiment, a diagram illustrates a cross-section of a device 10 with an antenna structure 12 reusing metallic components in the device 10. The device 10 includes an RF board 14, a power board 16, and a circuitry board 18. The board 14, 16, 18 can be Printed Circuit Boards (PCBs) or the like, and each has associated components for realizing functions in the device. The RF board 14 includes wireless components, the power board 16 includes power components, and the circuitry board 18 include electrical circuitry, an AC-DC converter, a DC-DC transformer, and the like. The boards 14, 16, 18 are adjacent to metal components 20, 22, 24 which act as heat sinks. In this exemplary embodiment, the device 10 includes a top heat sink 20 adjacent to the RF board 14, a middle heat sink 22 between the RF board 14 and the power board 16, and a bottom heat sink 24 adjacent to the power board 16 and the circuitry board 18.

In an exemplary embodiment, the device 10 can be a wireless AP; however, those skilled in the art will recognize other types of devices are also contemplated. The configuration of the boards 14, 16, 18 and the heat sinks 20, 22, 24 are presented for illustration purposes. Those skilled in the art will recognize other physical configurations of the boards 14, 16, 18 and the heat sinks 20, 22, 24 are also contemplated herein. Additionally, the device 10 can include an electrical plug 26 configured to plug into an electrical outlet. Of note, the device 10 can include a physical housing encasing the boards 14, 16, 18 and the heat sinks 20, 22, 24, which is not shown in FIG. 1.

The heat sinks 20, 22, 24 are designed for thermal conductivity (heat flow is denoted by arrows 28 in FIG. 1). Specifically, the arrows 28 illustrate heat flow in the device 10. The circuitry board 18 emits heat flow into the heat sink 24 which provides it to the heat sinks 20, 22. The power board 16 emits heat flow into the heat sink 22 which provides it to the heat sink 20. The RF board emits heat flow into the heat sinks 20, 22.

The device 10 further includes cooling fins 30, 32, 34, 36 located and thermally connected to the heat sink 20. The cooling fins 30, 32, 34, 36 are designed to dissipate heat from the heat sinks 20, 22, 24 into the air. Preferably, the cooling fins 30, 32, 34, 36 are located in the physical housing of the device 10 with airflow. The cooling fins 30, 32, 34, 36 have a direct metal contact with the heat sink 20 via metal connections 38, 40, 42, 44, respectively.

In an exemplary embodiment, the cooling fins 30, 32, 34, 36 are antenna elements in conjunction with the heat sink 20. The device 10 can include a coaxial cable 46 connected to a connector 48 on the RF board 14 and to a connection on the cooling fin 30. Note, for illustration purposes, the coaxial cable 46 is shown for the cooling fin 30, but corresponding coaxial cables can be connected to the cooling fins 30, 32, 34, 36.

Again, in an exemplary embodiment, the device 10 is a wireless AP and the cooling fins 30, 32, 34, 36 can be antenna elements for two 2.4 GHz antennas and two 5 GHz antennas. Specifically, the antenna structure 12 can be a Planar Inverted-F Antenna (PIFA) with the cooling fins 30, 32, 34, 36 being the antenna elements, the metal connections 38, 40, 42, 44 being the short pin, and the heat sink 20 being the ground plane. Of note, the cooling fins 30, 32, 34, 36 are positioned as far away from one another as possible. Also, the antenna structure 12 can include additional antennas with FIG. 1 merely presenting an example with four antennas.

Antenna Types

Figure 2:
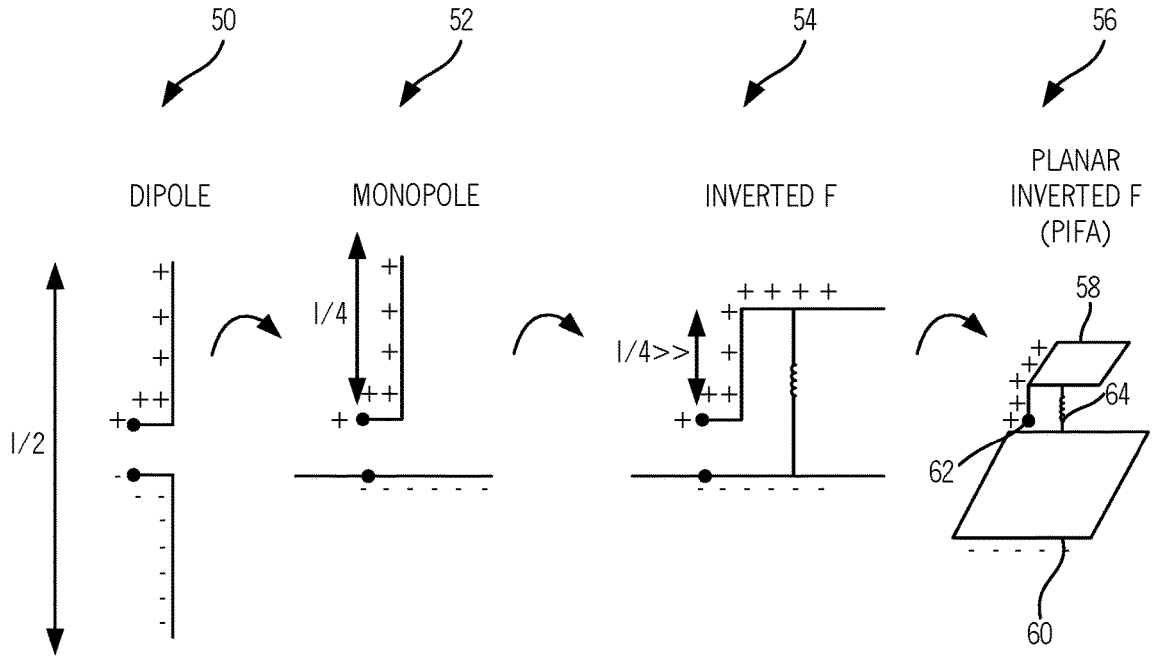
FIG. 2 is diagrams of various different antenna structures.

Referring to FIG. 2, in an exemplary embodiment, diagrams illustrate various different antenna structures 50, 52, 54, 56. Practically, antennas are made from two different ports, e.g., positive and negative ports. The antenna structure 50 is a dipole antenna formed by two conductors with a total length L of about a half wavelength ($\lambda/2$), the minimum length at which the antenna is resonant at the operating frequency. The two conductors are the positive and negative ports, and they are positioned in opposite directions to one another.

The antenna structure 52 is a monopole antenna which includes a straight rod-shaped conductor with a length of about one-fourth wavelength ($\lambda/4$), mounted perpendicularly over some type of conductive surface, called a ground plane. The antenna structure 54 is an inverted-F antenna which includes a monopole antenna running parallel to a ground plane and grounded at one end. The antenna is fed from an intermediate point a distance from the grounded end. The design has two advantages the monopole antenna: the inverted F antenna is shorter and more compact, and the impedance matching can be controlled by the designer without the need for extraneous matching components.

The antenna structure 56 is a PIFA antenna which includes an antenna element 58, a ground plane 60, an RF feed 62, and a short pin 64 connecting the antenna element 58 to the ground plane 60. In an exemplary embodiment, the device 10 includes the antenna structure 56 with the ground plane 60 formed by the heat sink 20, the antenna element 58 formed by the cooling fins 30, 32, 34, 36, and the short pin 64 formed by the metal connections 38, 40, 42, 44.

Conventional Device Design

Figure 3:
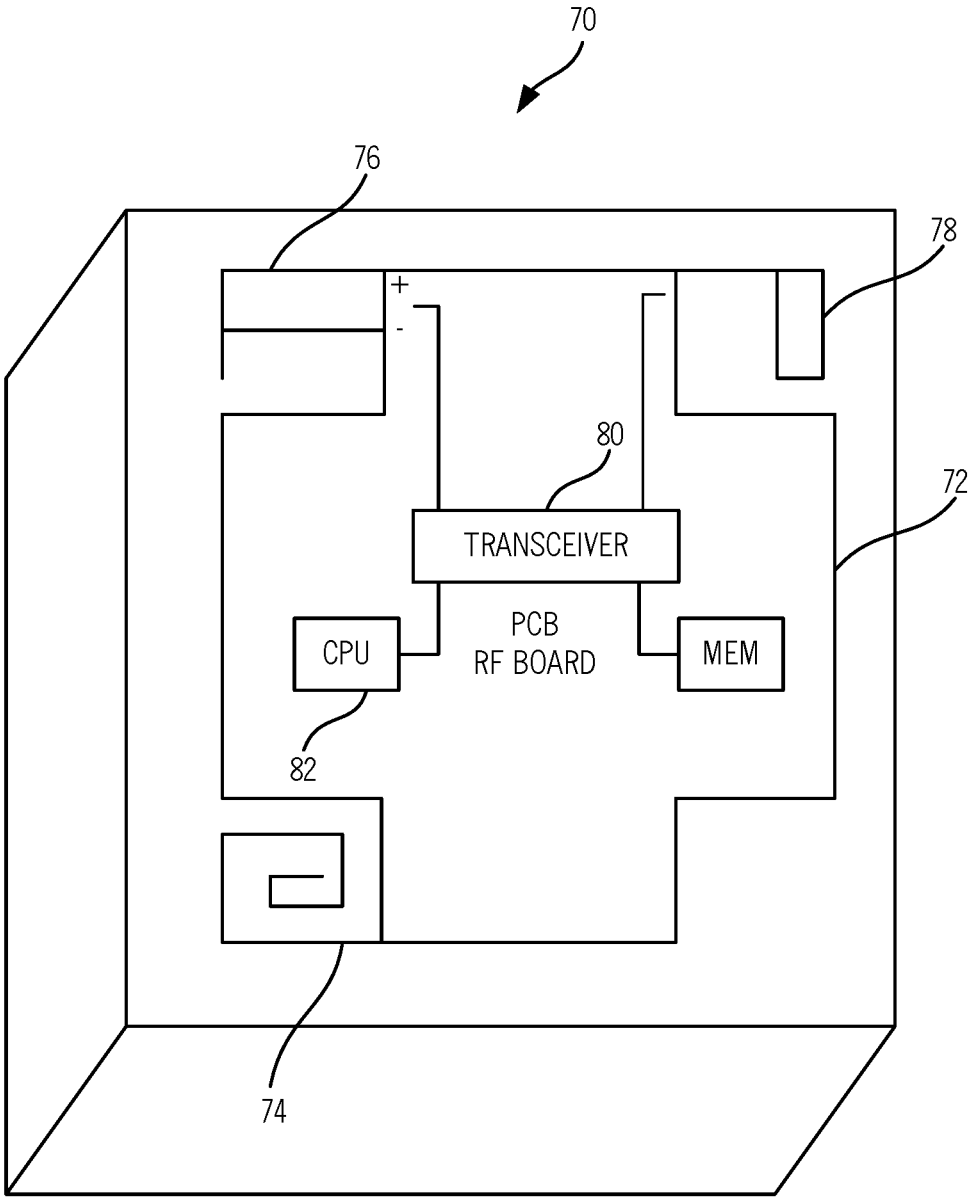
FIG. 3 Prior Art
FIG. 3 is a diagram of a conventional device with metal components cleared from antennas.

Referring to FIG. 3, a diagram illustrates a conventional device 70 with metal components 72 cleared from antennas 74, 76, 78. The conventional device 70 includes a transceiver 80, a processor 82, and other components which are omitted for illustration purposes. The metallic components 72 can include a heat sink, a heat spreader, a PCB, an RF board, etc. The exemplary antennas 74, 76, 78 can include a meander Inverted-F Antenna (IFA) 74, an IFA 76, and a PIFA 78. Of note, the conventional device 70 requires the metallic components 72 to be cleared from the antennas 74, 76, 78. As described herein, the device 10 reuses the metallic components 72 as part of the antenna, removing the requirements to clear the metallic components 72.

Heat Dissipation Via the Metallic Components as Antenna Elements

Figure 4:
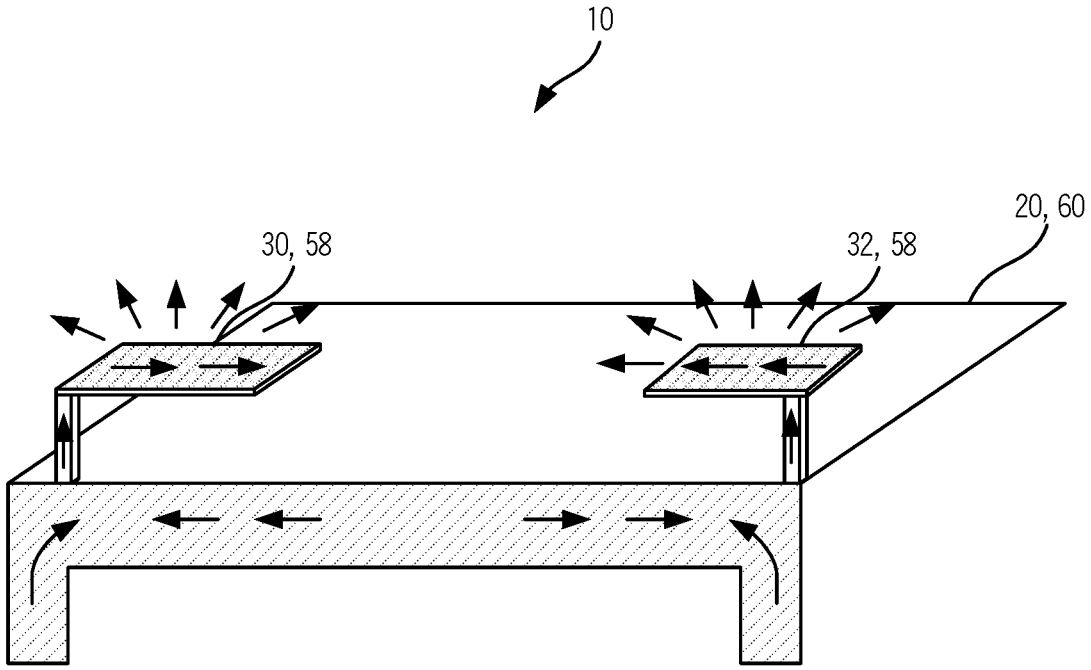
FIG. 4 is a diagram of a portion of the device of FIG. 1 illustrating heat dissipation via the metallic components as antenna elements.

Referring to FIG. 4, in an exemplary embodiment, a diagram illustrates a portion of the device 10 illustrating heat dissipation via the metallic components as antenna elements. Specifically, FIG. 4 illustrates the top heat sink 20 which acts as the ground plane 60 in a PIFA antenna structure 56 and two cooling fins 30, 32 which act as the antenna elements 58. Thus, the antenna structure 56 in addition to providing an antenna has heat transfer away from the top heat sink 20 with the antenna elements 58 also functioning as cooling fins 30, 32. The heat dissipates easier into the air as it spreads over the additional surface of the antenna elements 58.

Antenna Structure

Figure 5:
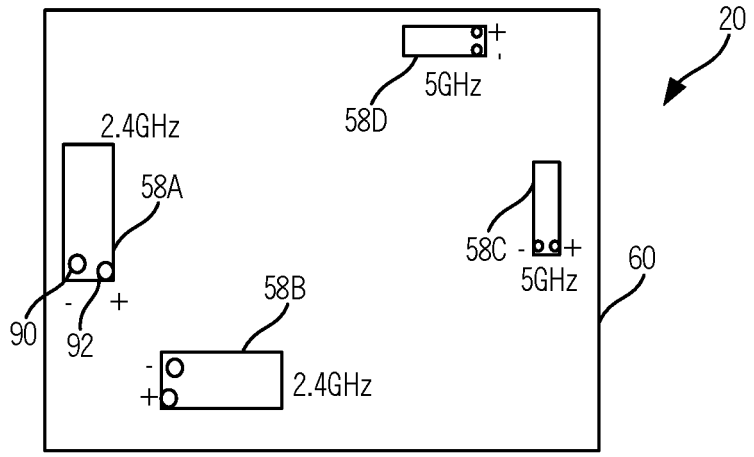
FIG. 5 is a diagram of a top view of a heat sink with placement of antenna elements.
Figure 6:
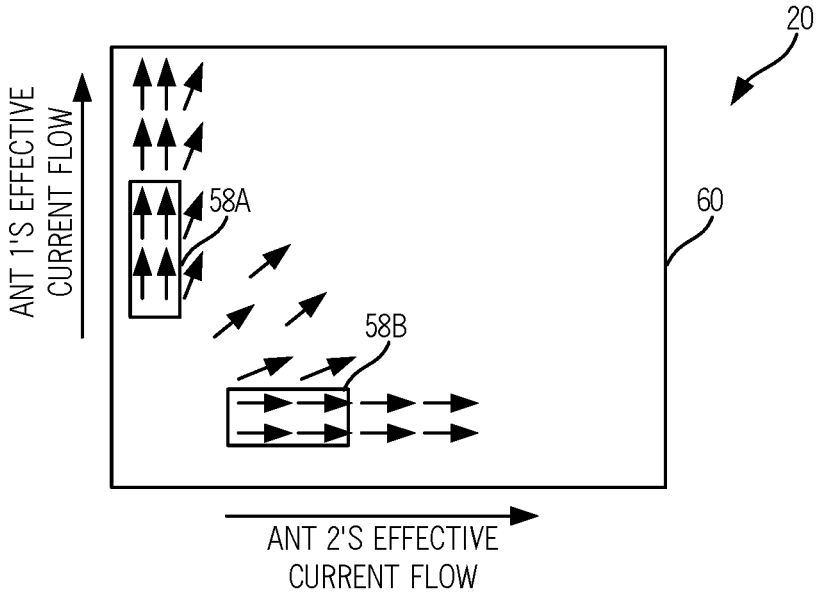
FIG. 6 is a diagram of a top view of the heat sink of FIG. 5 with effective current flow for two of the antenna elements.
Figure 7:
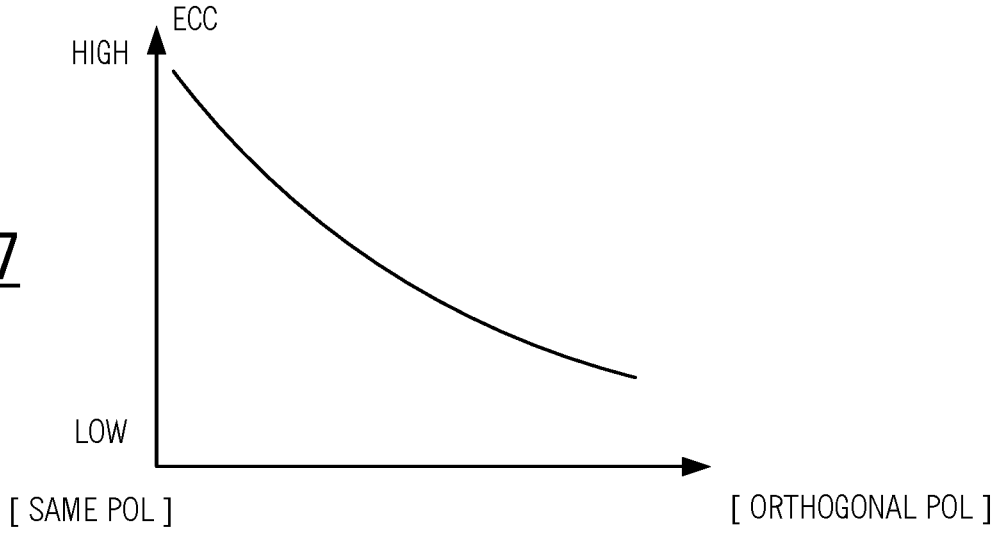
FIG. 7 is a graph of Envelope Correction Coefficient (ECC) for orthogonal current flow for the antenna elements 58A, 58B in the example of FIG. 6.

Referring to FIGS. 5 and 6, diagrams illustrate a top view of the heat sink 20 acting as a ground plane 60 for the antenna in the device 10. FIG. 5 illustrates a top view of the heat sink 20 with the placement of antenna elements 58A, 58B, 58C, 58D. FIG. 6 illustrates a top view of the heat sink 20 with the effective current flow for the antenna elements 58A, 58B. FIG. 7 is a graph of Envelope Correction Coefficient (ECC) for orthogonal current flow for the antenna elements 58A, 58B in the example of FIG. 6.

In FIG. 5, this example illustrates four antennas via the antenna elements 58A, 58B, 58C, 58D with the heat sink 20 acting as the ground plane 60. This exemplary embodiment can be for a wireless AP operating in both the 2.4 GHz and 5 GHz bands. For example, the antenna elements 58A, 58B can provide 2.4 GHz operation and the antenna elements 58C, 58D can provide 5 GHz operation, with the heat sink 20 as the ground plane 60 for each. Each of the antenna elements 58A, 58B, 58C, 58D include a metal connection 90 such as a screw connecting the antenna element 58 to the ground plane 60 and an antenna feed 92 such as a coaxial cable to RF components in the device 10. For example, the antenna feed 92 can be viewed as a positive port and the metal connection 90 is a negative port.

In an exemplary embodiment, the antenna elements 58A, 58B for the 2.4 GHz antenna operation are placed in one corner of the heat sink 20 to have the majority of current flow between each of the antenna elements 58A, 58B on the ground plane 60 (on top of the heat sink 20) in orthogonal directions from one another. This is illustrated in FIG. 6. Specifically, the effective current flow for the antenna element 58A on the ground plane 60 is in an upward direction (logically in FIG. 6) and the effective current flow for the antenna element 58B are in a rightward direction (logically in FIG. 6). Note, the antenna elements 58B, 58C for the 5 GHz antenna operation operate in a similar manner with the orthogonal effective current flow. In FIG. 7, a graph of Envelope Correction Coefficient (ECC) for orthogonal current flow for the antenna elements 58A, 58B shows that the orthogonal current flow based on the placement of the antenna elements 58A, 58B in FIGS. 5 and 6 reduce ECC.

Isolation Between Antenna Elements

Figure 8:
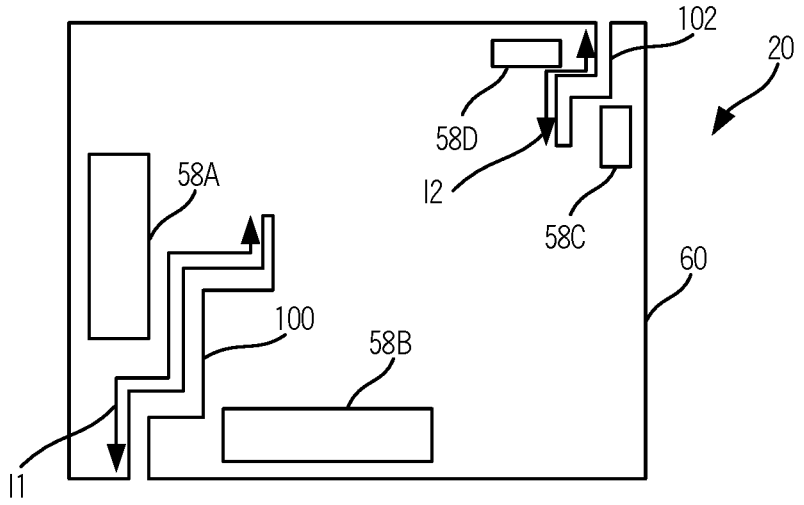
FIG. 8 is a diagram of a top view of the heat sink from FIG. 5 with the antenna elements and slits included in the ground plane for isolation.
Figure 9:
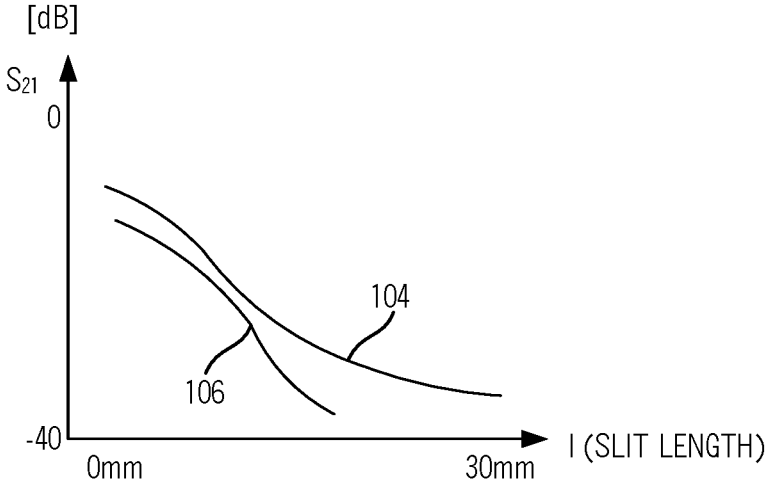
FIG. 9 is a graph showing the transmission coefficient, $S_{21}$, based on the slit length in the ground plane.
Figure 10:
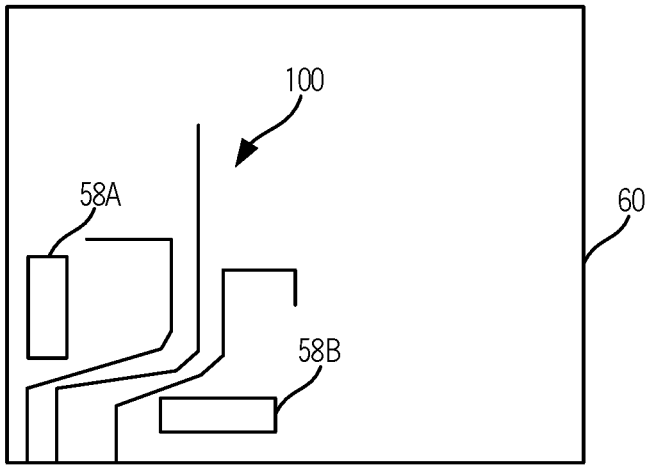
FIG. 10 is a diagram of a top view of the heat sink from FIG. 5 with various exemplary slit patterns in the ground plane.

Referring to FIGS. 8-12, in an exemplary embodiment, slit, slots, etc. can be incorporated into the heat sink 20 for isolation in the ground plane 60. FIG. 8 illustrates a top view of the heat sink 20 from FIG. 5 with the antenna elements 58A, 58B, 58C, 58D and slits included in the ground plane 60 for isolation. FIG. 9 is a graph showing the transmission coefficient, $S_{21}$, based on the slit length in the ground plane 60. FIG. 10 illustrates a top view of the heat sink 20 from FIG. 5 with various exemplary slit patterns in the ground plane 60.

In FIG. 8, the heat sink 20 includes the same antenna elements 58A, 58B, 58C, 58D as in FIG. 5. Further, the heat sink 20 includes slits 100, 102 between respective antenna elements 58A, 58B, 58C, 58D. The slits 100 are openings in the heat sink 20 to provide additional isolation between the antenna elements 58A, 58B, 58C, 58D. Specifically, the slit 100 is between the antenna elements 58A, 58B and the slit 102 is between the antenna elements 58C, 58D. The slit 100 has a length of $l_1$ and the slit 102 has a length of $l_2$.

The slits 100, 102 can be cut anywhere between the feed of the antenna elements 58A, 58B and the feed of the antenna elements 58C, 58D and can meander towards a center of the top of the heat sink 20. FIG. 9 is a graph illustrating the reduction of the transmission coefficient, $S_{21}$, based on the slit length with a line 104 for the $S_{21}$ of the antennas associated with antenna elements 58A, 58B and with a line 106 for the $S_{21}$ of the antennas associated with antenna elements 58C, 58D.

FIG. 10 illustrates example meander patterns for the slit 100. The pattern of the slits 100, 102 can vary as required for manufacturing, for heat dissipation, etc., but the pattern should cut between the feeds 92 of the antenna elements 58A, 58B and meander towards a center of the heat sink 20.

Figure 11:
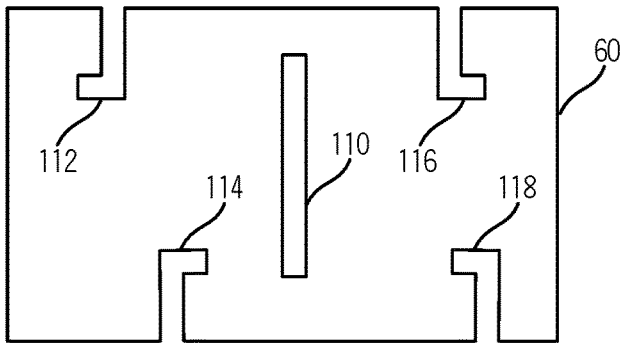
FIG. 11 is a diagram of a top view of the heat sink from FIG. 5 with the antenna elements and slits and slots included in the ground plane for isolation.
Figure 12:
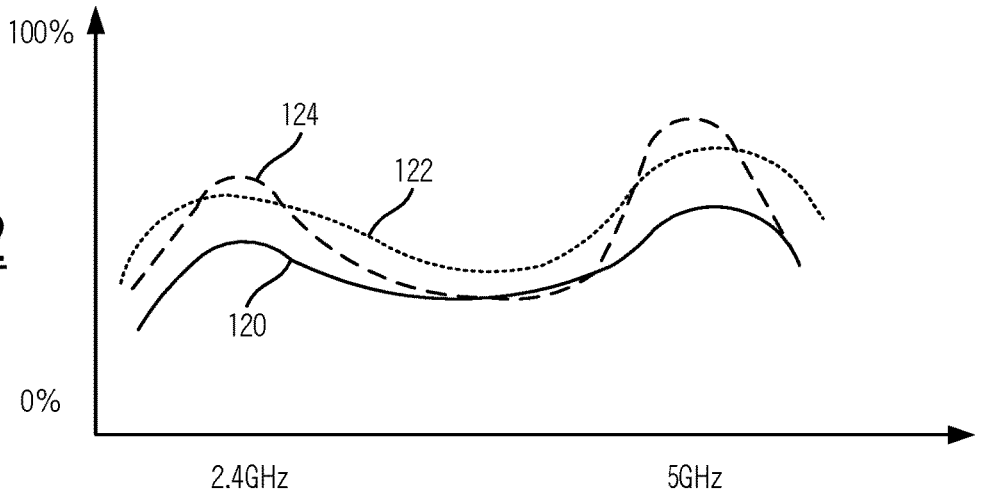
FIG. 12 is a graph of antenna efficiency for the antenna elements based on adding slots or slits.

FIG. 11 illustrates a top view of the heat sink 20 from FIG. 5 with the antenna elements 58A, 58B, 58C, 58D and slits and slots included in the ground plane 60 for isolation. FIG. 12 is a graph of antenna efficiency for the antenna elements 58A, 58B, 58C, 58D based on adding slots or slits. In FIG. 11, the heat sink 20 has a slot 110 in the middle and slits 112, 114, 116, 118. The pattern can be optimized by modifying the heat sink 20 by adding holes, slits, and/or slots. In the example of FIG. 11, the heat sink 20 can support eight antenna elements 58 with a corresponding slit 112, 114, 116, 118 between each pair. This could be used in a 4×4 dual band wireless AP. Those skilled in the art will recognize various patterns are contemplated.

In FIG. 12, a graph illustrates antenna efficiency with three lines 120, 122, 124 for the device 10 as a wireless AP operating at the 2.4 GHz and 5 GHz bands. The line 120 represents the heat sink 20 with no cuts on top of the heat sink 20, i.e., the example of FIG. 5. The line 122 represents the heat sink 20 with a slot added, such as the slot 110 in the example of FIG. 11. The line 124 represents the heat sink 20 with slits added, such as the slits 112, 114, 116, 118 in the example of FIG. 11.

RF/EMI/EMC Shield/Faraday Cage

Figure 13:
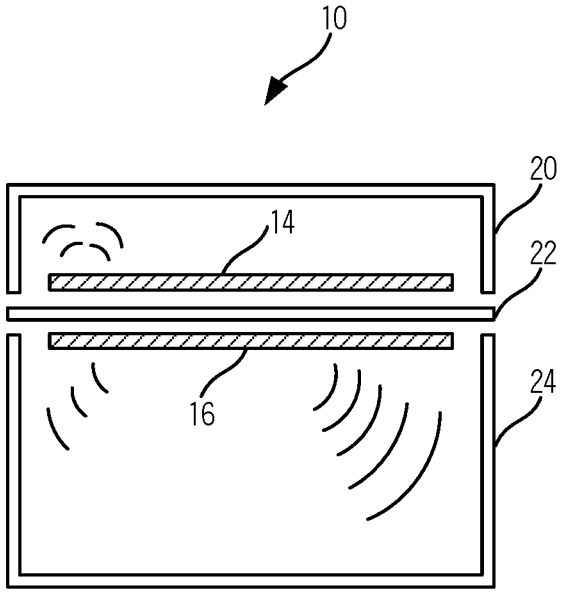
FIG. 13 is a diagram of a cross-sectional view of the device illustrating operation as an RF/EMI/EMC shield and Faraday cage.

Referring to FIG. 13, in an exemplary embodiment, a diagram illustrates a cross-sectional view of the device 10 illustrating operations as an RF/EMI/EMC shield and Faraday cage. The upper heat sink 20 covers the RF board 14, the lower heat sink 24 covers the power board 16, and there is the middle heat sink 22 between the RF board 14 and the power board 16. Again, the heat sink 20 can serve as the ground plane 60 with the associated antenna elements 58. Collectively the heat sinks 20, 22, 24 form a box—i.e., an RF/EMI/EMC shield and/or Faraday cage. The RF board 14 is a source of harmonics and out-of-band emissions. The power board 16 is a source of unwanted emissions. The heat sinks 20, 22, 24 short out out-of-band emissions, harmonics, and unwanted emissions.

Heat Transfer/Antenna Element

Referring to FIGS. 14-17, in an exemplary embodiment, diagrams illustrate portions of the device 10 for heat transfer between the heat sink 20 and the antenna elements 58 acting as the cooling fins 30, 32, 34, 36. FIG. 14 is a perspective diagram of an exemplary heat sink 20 on top of an exemplary RF board 14. FIG. 15 is a diagram of a side view illustrating connectivity between the RF board 14, the heat sink 20, and the antenna element 58. FIG. 16 is a diagram of a side view of the antenna element 58 illustrating an exemplary shape. FIG. 17 is a graph of the reflection coefficient, $S_{11}$, illustrating effects based on the shape of the antenna element 58.

In FIG. 15, the connections are illustrated between the RF board 14, the heat sink 20, and the antenna element 58. FIG. 15 illustrates a single antenna formed by the heat sink 20 as the ground plane, the cooling fin 30 as the antenna element 58, the metal connection 38 as the short pin 64 between the antenna element 58 and the ground plane, and the coaxial cable 46 as the RF feed 62 connected to the RF board 14 via the connector 48 and to the antenna element 58 via the antenna feed 92. Again, this exemplary antenna is a PIFA type antenna. There can be a plastic carrier 130 (or some other non-conductive material) disposed between the heat sink 20 and the cooling fin 30. The plastic carrier 130 can provide physical support for the cooling fin 30/antenna element 58. In an exemplary embodiment, the metal connection 38 is a screw of an appropriate diameter and material supporting both electrical and thermal conductivity. The heat conductive connection between the antenna element and the heat sink does not need to be electrically conductive. For example a ceramic screw with good heat conduction could be used. In this case the antenna type would not be a PIFA style, but could be a dipole, monopole, or other type of antenna structure in which the antenna element does not have an electrical connection to the ground plane.

In FIG. 16, the antenna element 58 is illustrated with an exemplary shape and an inductance loop 140 to the heat sink 20 via the metal connection 38. The inductance loop 140 is a path that current may take which helps matching. In this exemplary shape, the antenna element 58 has three top portions with lengths T, L, R, respectively. FIG. 17 is a graph of the reflection coefficient, $S_{11}$, illustrating effects based on the shape of the antenna element 58. Specifically, the value of length L is used to tune the antenna frequency, e.g., in a wireless AP to 2.4 GHz and/or 5 GHz. The value of lengths L, T is used to get bigger dips as shown by the lines in FIG. 17 and better matching.

Figure 18:
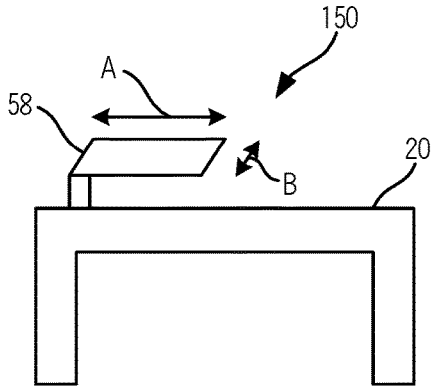
FIG. 18 is a diagram of a PIFA antenna using the cooling fin as the antenna element and the heat sink as the ground plane.
Figure 19:
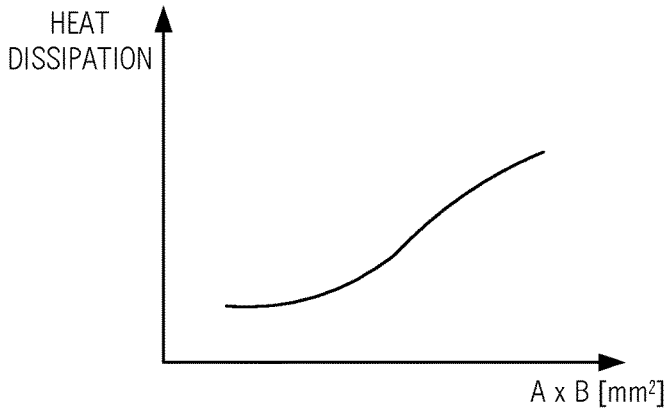
FIG. 19 is a graph of heat dissipation of the cooling fin in the PIFA antenna of FIG. 18 based on surface area.
Figure 20:
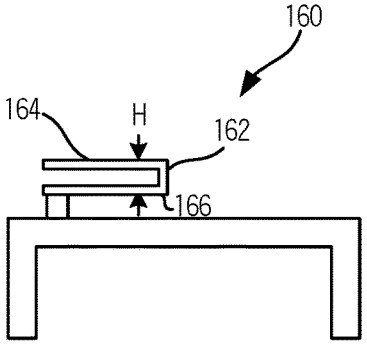
FIG. 20 is a diagram of a PIFA antenna with a folded antenna element to increase the surface area of the cooling fin.
Figure 21:
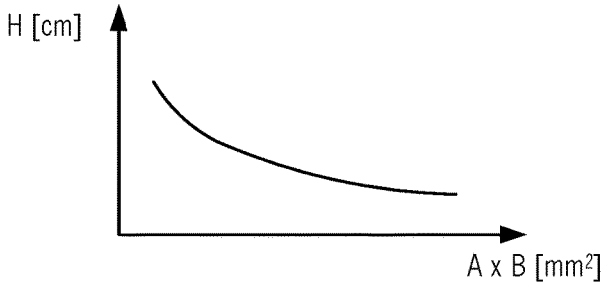
FIG. 21 is a graph illustrating a size of the folded antenna element versus the surface area of the folded antenna element in the PIFA antenna of FIG. 20.

Referring to FIGS. 18, 19, 20, and 21, in an exemplary embodiment, the size of the antenna element 58 can be adjusted to dissipate more heat to the air as the cooling fin 30. FIG. 18 is a PIFA antenna 150 using the cooling fin 30 as the antenna element 58 and the heat sink 20 as the ground plane 60. FIG. 19 is a graph illustrating heat dissipation of the cooling fin 30 in the PIFA antenna 150 based on surface area. FIG. 20 is a PIFA antenna 160 with a folded antenna element 162 to increase the surface area of the cooling fin 30. FIG. 21 is a graph illustrating a size of the folded antenna element 162 versus the surface area of the folded antenna element 162 in the PIFA antenna 160.

In FIG. 18 in the PIFA antenna 150, the antenna element 58 is has a length A and a height B (which may be angled or straight). As shown in FIG. 19, the larger the effective surface area of the antenna element 58 (as the cooling fin 30), the more heat is dissipated into the air. In FIG. 19, to keep the resonance length the same (as the antenna element 58 is made larger for better heat dissipation), the PIFA antenna 160 can have the antenna element 162 folded with a folded port 164 and a bottom port 166. A value H defines the distance between the folded port 164 and the bottom port 166. If h is short enough, the folded port 164 and the bottom port 166 are electrically one piece due to cooperative coupling at the frequency of interest (e.g., 2.4 GHz, 5 GHz, etc.). In FIG. 21, when A×B increases, the value H can be increased as there is some required capacitance for making the folding antenna element 162 seem electrically as one piece with the unchanged resonance frequency. The capacitance is about A×B/H.

Referring to FIGS. 22, 23, and 24, in an exemplary embodiment, the size of the metal connection 38 can be adjusted for optimized heat transfer between the heat sink 20 and the cooling fin 30, 32. FIG. 22 illustrates the device 10 with two cooling fins 30, 32 with varying sized metal connections 38, 40. FIG. 23 is a graph of heat transfer between the antenna element 58 based on the size of the metal connections 38, 40. FIG. 24 illustrates a top view of the antenna element 58 illustrating different sizes for the antenna element 58 and the metal connection 38. The same relationships would hold for heat conduction through a non-electrically conducting material such as a ceramic material. The larger the cross section of the material, the better the heat transfer will be.

The metal connections 38, 40 connect to the metal connection 90 on the antenna elements 58 (which are also the cooling fins 30, 32). For traditional grounding, the antenna element 58 is connected to the ground plane 60 via a wire. In the antenna structure described herein, the metal connections 38, 40 and the metal connection 90 have a significantly wider cross-section than a wire. Instead, the metal connections 38, 40 are screws or some other metal component of diameter d. The metal components thus both provide electrical conductivity just as the wire does, but also the metal components provide thermal conductivity between the heat sink 20 and the cooling fins 30, 32. The graph in FIG. 23 illustrates heat transfer via the metal connections 38, 40 based on the diameter of the screw.

FIG. 24 illustrates that the antenna elements 58 have to adjust in size as the metal connections 38, 40 diameter increases. For example, with a diameter d, the antenna element 58 has a size indicated by the dotted line in FIG. 24 and with a diameter **2*d*, the antenna element 58 has a size indicated by the solid line in FIG. 24**.

Figure 25:
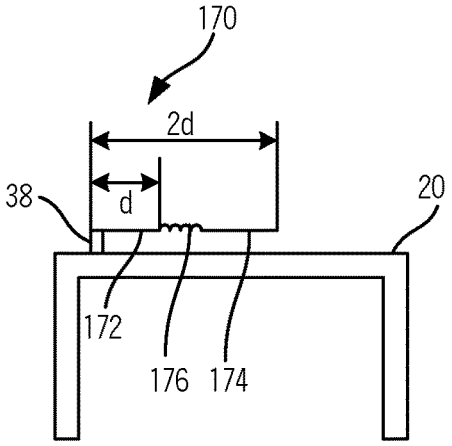
FIG. 25 is a diagram of an antenna element with increased size with a metal plate disconnected in terms of the desired frequency, but connected in terms of heat dissipation.
Figure 26:
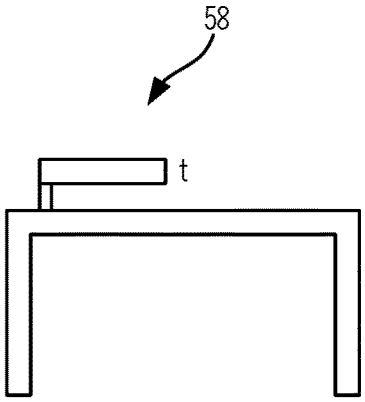
FIG. 26 is a diagram increasing a thickness of the antenna element.
Figure 27:
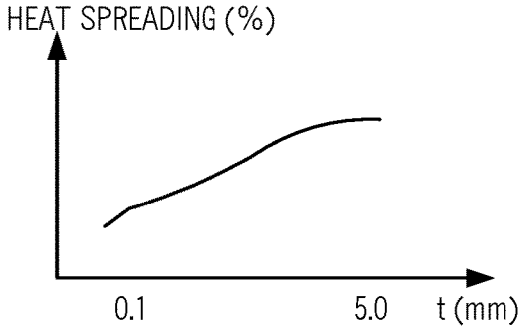
FIG. 27 is a graph of heat spreading as a function of thickness.
Figure 28:
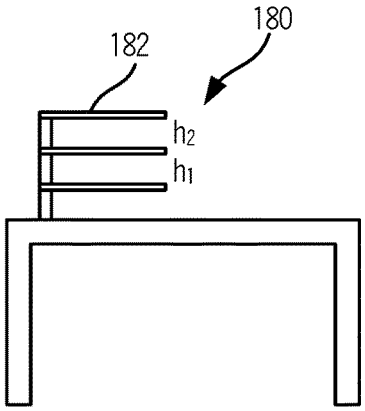
FIG. 28 is a diagram of a stacked antenna element to increase surface area for heat spreading.

Referring to FIGS. 25, 26, 27, and 28, in an exemplary embodiment, various techniques are illustrated for adjusting the size of the antenna element 58. FIG. 25 illustrates an antenna element 170 with increased size with a metal plate disconnected in terms of the desired frequency but connected in terms of heat dissipation. FIG. 26 illustrates increasing a thickness of the antenna element 58. FIG. 27 illustrates a graph of heat spreading as a function of thickness. FIG. 28 illustrates a stacked antenna element 180 to increase surface area for heat spreading.

In FIG. 25, the size of the antenna element 170 is increased to support more heat dissipation while the increased size does not affect the RF operation of the antenna element 170. Here, there are two metal plates 172, 174 interconnected by an inductor 176. The metal plate 172 has a length d while the combination of the metal plates 172, 174 with the inductor 176 has a length 2*d*. Thus, the antenna element 170 significantly increases heat spreading since the plates 172, 174 or elements, but since they are connected with the inductor 176, only the plate 172 closest to the metal connection 38 resonates maintaining a frequency of interest unchanged by adding/extending elements.

In FIG. 26, the antenna element 58 is increased in thickness, t. FIG. 27 illustrates a graph showing the increased heat spreading based on the thickness, t.

In FIG. 28, the antenna element 180 includes multiple plates 182 stacked with distances $h_1$, $h_2$, etc. between one another. Again, the stacked plates 182 increase the surface area for heat spreading and by keeping the distances $h_1$, $h_2$, etc. short, the stacked plates 182 make these look the same from an RF perspective (e.g., at 2.4 GHz, 5 GHz, etc.).

Wireless Access Point

Figure 29:
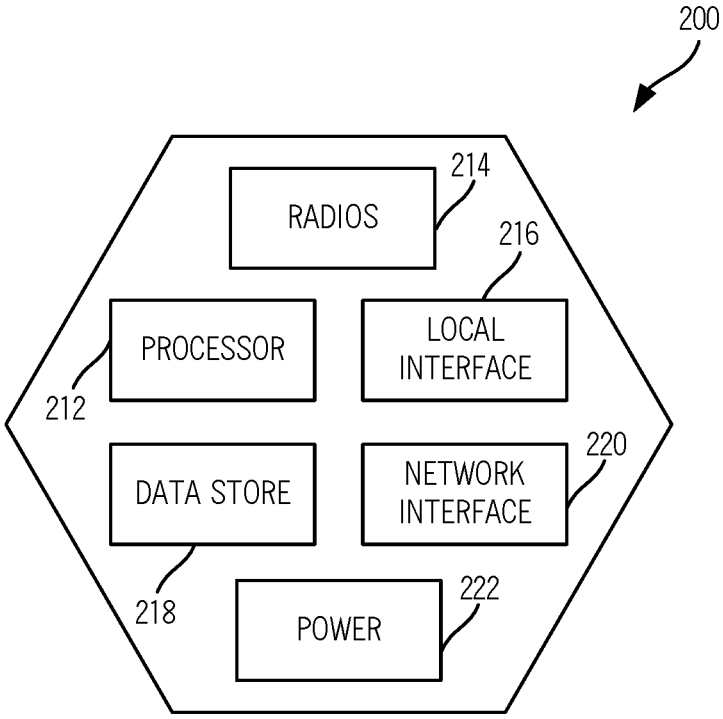
FIG. 29 is a block diagram of functional components of a wireless Access Point (AP) utilizing the antenna structure with reuse of metallic components.
Figure 30:
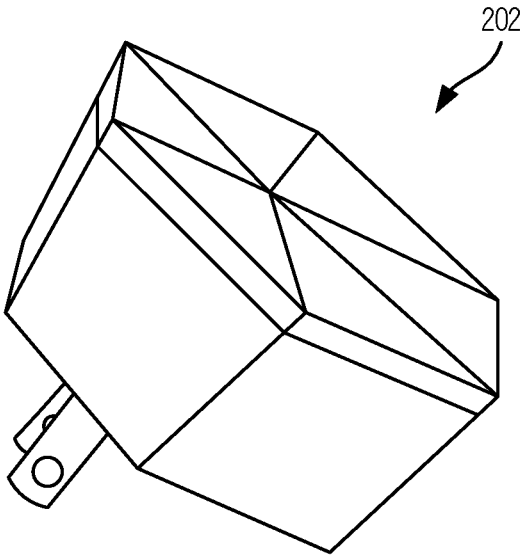
FIG. 30 is a perspective diagram of a physical form factor for the wireless AP of FIG. 29.

Referring to FIG. 29, in an exemplary embodiment, a block diagram illustrates functional components of a wireless AP 200 utilizing the antenna structure with reuse of metallic components. Referring to FIG. 30, in an exemplary embodiment, a perspective diagram illustrates a physical form factor 202 for the wireless AP 200. The AP 200 includes a physical form factor 202 which contains a processor 212, a plurality of radios 214, a local interface 216, a data store 218, a network interface 220, and power 222. It should be appreciated by those of ordinary skill in the art that FIG. 29 depicts the AP 200 in an oversimplified manner, and a practical embodiment may include additional components and suitably configured processing logic to support features described herein or known or conventional operating features that are not described in detail herein.

In an exemplary embodiment, the form factor 202 is a compact physical implementation where the AP 200 directly plugs into an electrical socket and is physically supported by the electrical plug connection to the electrical socket. This compact physical implementation is ideal for a large number of APs 200 distributed throughout a residence. The processor 212 is a hardware device for executing software instructions. The processor 212 can be any custom made or commercially available processor, a central processing unit (CPU), an auxiliary processor among several processors, a semiconductor-based microprocessor (in the form of a microchip or chip set), or generally any device for executing software instructions. When the AP 200 is in operation, the processor 212 is configured to execute software stored within memory or the data store 218, to communicate data to and from the memory or the data store 218, and to generally control operations of the AP 200 pursuant to the software instructions. In an exemplary embodiment, the processor 212 may include a mobile-optimized processor such as optimized for power consumption and mobile applications.

The radios 214 enable wireless communication. The radios 214 can operate according to the IEEE 802.11 standard. The radios 214 include address, control, and/or data connections to enable appropriate communications on a Wi-Fi system. As described herein, the AP 200 includes a plurality of radios to support different links, i.e., backhaul links and client links. In an exemplary embodiment, the AP 200 can support dual band operation simultaneously operating 2.4 GHz and 5 GHz 2×2 MIMO 802.11b/g/n/ac radios having operating bandwidths of 20/40 MHz for 2.4 GHz and 20/40/80 MHz for 5 GHz. For example, the AP 200 can support IEEE 802.11AC1200 gigabit Wi-Fi (300+867 Mbps).

The radios 214 contemplate using the antenna structure described herein. For example, the 2×2 MIMO implementation can be as illustrated in FIGS. 1, 5, etc. All components described herein with reference to the device 10 can be included in the physical form factor 202. That is, the heat sinks 20, 22, 24 and the cooling fins 30, 32, 34, 34 along with all of the other components described herein.

The local interface 216 is configured for local communication to the AP 200 and can be either a wired connection or wireless connection such as Bluetooth or the like. Since the AP 200 can be configured via the cloud, an onboarding process is required to first establish connectivity for a newly turned on AP 200. In an exemplary embodiment, the APs 200 can also include the local interface 216 allowing connectivity to a user device for onboarding to a Wi-Fi system such as through an app on the user device. The data store 218 is used to store data. The data store 218 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 218 may incorporate electronic, magnetic, optical, and/or other types of storage media.

The network interface 220 provides wired connectivity to the AP 200. The network interface 220 may be used to enable the AP 200 communicate to a modem/router. Also, the network interface 220 can be used to provide local connectivity to a user device. For example, wiring in a device to an AP 200 can provide network access to a device which does not support Wi-Fi. The network interface 220 may include, for example, an Ethernet card or adapter (e.g., 10BaseT, Fast Ethernet, Gigabit Ethernet, 10 GbE). The network interface 220 may include address, control, and/or data connections to enable appropriate communications on the network. The processor 212 and the data store 218 can include software and/or firmware which essentially controls the operation of the AP 200, data gathering and measurement control, data management, memory management, and communication and control interfaces with the cloud.

It will be appreciated that some exemplary embodiments described herein may include one or more generic or specialized processors ("one or more processors") such as microprocessors; Central Processing Units (CPUs); Digital Signal Processors (DSPs): customized processors such as Network Processors (NPs) or Network Processing Units (NPUs), Graphics Processing Units (GPUs), or the like; Field Programmable Gate Arrays (FPGAs); and the like along with unique stored program instructions (including both software and firmware) for control thereof to implement, in conjunction with certain non-processor circuits, some, most, or all of the functions of the methods and/or systems described herein. Alternatively, some or all functions may be implemented by a state machine that has no stored program instructions, or in one or more Application Specific Integrated Circuits (ASICs), in which each function or some combinations of certain of the functions are implemented as custom logic or circuitry. Of course, a combination of the aforementioned approaches may be used. For some of the exemplary embodiments described herein, a corresponding device in hardware and optionally with software, firmware, and a combination thereof can be referred to as "circuitry configured or adapted to," "logic configured or adapted to," etc. perform a set of operations, steps, methods, processes, algorithms, functions, techniques, etc. on digital and/or analog signals as described herein for the various exemplary embodiments.

Moreover, some exemplary embodiments may include a non-transitory computer-readable storage medium having computer readable code stored thereon for programming a computer, server, appliance, device, processor, circuit, etc. each of which may include a processor to perform functions as described and claimed herein. Examples of such computer-readable storage mediums include, but are not limited to, a hard disk, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory), Flash memory, and the like. When stored in the non-transitory computer readable medium, software can include instructions executable by a processor or device (e.g., any type of programmable circuitry or logic) that, in response to such execution, cause a processor or the device to perform a set of operations, steps, methods, processes, algorithms, functions, techniques, etc. as described herein for the various exemplary embodiments.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. An antenna system reusing metallic components in a device, the antenna system comprising:

a first antenna element which is also configured to transfer heat into surrounding air;

a ground plane which is part of reused metallic components in the device for heat dissipation; and a first physical connection between the first antenna element and the ground plane which supports thermal conductivity based on an associated size and material of the first physical connection, wherein the first physical connection is metal, and supports both electrical conductivity and thermal conductivity, and wherein the first antenna element comprises an inductance loop between the ground plane via the first metal connection and an antenna connection.

2. The antenna system of claim 1, wherein the reused metallic components comprise a Faraday cage and/or Electromagnetic Interference (EMI) shield for circuitry in the device.

3. The antenna system of claim 1, wherein the first antenna element further operates as a cooling fin, and wherein the ground plane is part of a heat sink in the device.

4. The antenna system of claim 1, further comprising:

a second antenna element which is also configured to transfer heat into surrounding air, wherein the second antenna element shares the ground plane with the first antenna element; and a second physical connection between the second antenna element and the ground plane which supports thermal conductivity based on an associated size and material of the second physical connection.

5. The antenna system of claim 4, wherein the first antenna element and the second antenna element are positioned such that effective current flow from the first antenna element and the second antenna element is substantially orthogonal to one another on the ground plane.

6. The antenna system of claim 4, wherein the second physical connection is metal, and supports both electrical conductivity and thermal conductivity.

7. The antenna system of claim 4, wherein the ground plane comprises one or more slits or slots between the first antenna element and the second antenna element.

8. The antenna system of claim 1, wherein the first antenna element is a folded or stacked element to increase the heat transfer.

9. The antenna system of claim 1, further comprising:

an extension plate connected to the first antenna element via an inductor, to increase the heat transfer.

10. The antenna system of claim 1, further comprising:

a second antenna element, a third antenna element, and a fourth antenna element each of which is also configured to transfer heat into surrounding air, wherein the second antenna element, the third antenna element, and the fourth antenna element shares the ground plane with the first antenna element; and a second physical connection between the second antenna element and the ground plane, a third physical connection between the third antenna element and the ground plane, and a fourth physical connection between the fourth element and the ground plane each of which supports thermal conductivity based on an associated size and material of the respective connection.

11. The antenna system of claim 10, wherein the first antenna element and the second antenna element are positioned such that effective current flow from the first antenna element and the second antenna element is substantially orthogonal to one another on the ground plane, and wherein the third antenna element and the fourth antenna element are positioned such that effective current flow from the third antenna element and the fourth antenna element is substantially orthogonal to one another on the ground plane.

12. The antenna system of claim 10, wherein the ground plane comprises one or more slits or slots between the first antenna element, the second antenna element, the third antenna element, and the fourth antenna element.

13. The antenna system of claim 1, wherein the reused metallic components substantially surround one or more of a Radio Frequency (RF) board, a power board, and a Printed Circuit Board (PCB) in the device.

14. A combined antenna and heat sink apparatus in a device, the combined antenna and heat sink apparatus comprising:

a heat sink structure enclosing one or more of a Radio Frequency (RF) board, a power board, and a Printed Circuit Board (PCB) in the device, wherein the heat sink structure is one or more of a Faraday cage and/or Electromagnetic Interference (EMI) shield for circuitry and power in the device; and one or more antenna elements thermally coupled to the heat sink structure such that the heat sink structure operates as a ground plane to the one or more antenna structure, the one or more antenna elements operate as cooling fins for the heat sink.

15. The combined antenna and heat sink apparatus of claim 14, wherein the one or more antenna elements comprise at least two antenna elements positioned such that effective current flow is substantially orthogonal to one another on the ground plane.

16. The combined antenna and heat sink apparatus of claim 14, wherein the heat sink structure comprises one or more slits or slots between the electrical coupling of the one or more antenna elements.

17. A wireless Access Point (AP) with an antenna structure reusing metallic components in the wireless AP, the wireless AP comprising:

Radio Frequency (RF) components;

circuitry and power components;

a heat sink structure adjacent to the RF components and/or the circuitry and power components;

one or more 2.4 GHz antenna elements thermally coupled to the heat sink structure such that the heat sink structure acts as a ground plane to the one or more 2.4 GHz antenna elements; and one or more 5 GHz antenna elements thermally coupled to the heat sink structure such that the heat sink structure acts as the ground plane to the one or more 5 GHz antenna elements.

18. The wireless AP of claim 16, wherein the one or more 2.4 GHz antenna elements and the one or more 5 GHz antenna elements act as cooling fins for the heat sink structure.

19. An antenna system reusing metallic components in a device, the antenna system comprising:

a first antenna element which is also configured to transfer heat into surrounding air;

a ground plane which is part of reused metallic components in the device for heat dissipation;

a first physical connection between the first antenna element and the ground plane which supports thermal conductivity based on an associated size and material of the first physical connection;

a second antenna element which is also configured to transfer heat into surrounding air, wherein the second antenna element shares the ground plane with the first antenna element; and a second physical connection between the second antenna element and the ground plane which supports thermal conductivity based on an associated size and material of the second physical connection.

20. An antenna system reusing metallic components in a device, the antenna system comprising:

a first antenna element which is also configured to transfer heat into surrounding air;

a ground plane which is part of reused metallic components in the device for heat dissipation;

a first physical connection between the first antenna element and the ground plane which supports thermal conductivity based on an associated size and material of the first physical connection; and an extension plate connected to the first antenna element via an inductor, to increase the heat transfer.

* * * * *